United States Patent [19]

Luebrecht

[11] Patent Number: 4,552,250

[45] Date of Patent: Nov. 12, 1985

[54] LIFT TRUCK

[75] Inventor: Donald Luebrecht, Fort Jennings, Ohio

[73] Assignee: Crown Controls Corporation, New Bremen, Ohio

[21] Appl. No.: 487,625

[22] Filed: Apr. 22, 1983

[51] Int. Cl.[4] ..... B66B 9/20; B66B 7/02

[52] U.S. Cl. ..... 187/9 E; 187/95; 182/141

[58] Field of Search ..... 187/9 E, 9 R, 95; 182/141, 148, 63; 254/405

[56] References Cited

U.S. PATENT DOCUMENTS

| | | | |
|---|---|---|---|
| Re. 24,958 | 3/1961 | Ehmann . | |
| 3,035,663 | 5/1962 | Mehlmann | 187/9 E |
| 3,095,945 | 7/1963 | Mitchell | 187/9 E |
| 3,344,890 | 10/1967 | Loef | 187/9 E |
| 3,937,346 | 2/1976 | van der Laan . | |
| 3,998,346 | 12/1976 | Gibson et al. . | |
| 4,087,626 | 5/1978 | Luebrecht et al. | 178/22.12 |
| 4,236,862 | 12/1980 | McCormick . | |
| 4,354,579 | 10/1982 | Low | 187/95 |

FOREIGN PATENT DOCUMENTS

| | | | |
|---|---|---|---|
| 1273422 | 7/1968 | Fed. Rep. of Germany | 187/9 E |

*Primary Examiner*—Joseph J. Rolla
*Assistant Examiner*—Andrew Jones
*Attorney, Agent, or Firm*—Biebel, French & Nauman

[57] ABSTRACT

A lift truck having a frame and a two-stage telescopic mast in which an outer, movable mast is mounted to telescope over an inner mast which is fixed to the frame, each mast having a substantially continuous, unitary tubular body which provides superior strength characteristics in response to torsional loads and bending moments. The masts each include vertically extending beams, integral with the tubular bodies thereof, having tracks to receive rollers mounted to the beams so that the only contact between the masts is by the rollers. The beams of the outer mast include tracks which receive the rollers of a platform having a lifting fork structure and which is vertically movable relative to the outer mast.

8 Claims, 9 Drawing Figures

LIFT TRUCK

BACKGROUND OF THE INVENTION

The present invention relates to lift trucks, and more particularly, to lift trucks having two-stage primary masts.

In most warehouses, and especially in warehouses of the type which store palletized goods, profitability of the warehousing operation can be increased by maximizing the useage of available floor space. Accordingly, such warehouses are designed to make the aisles between racks as narrow as possible, and to make the racks upon which the pallets are stored as high as possible, thereby increasing the number of pallets stored per unit of floor space.

In response to this trend in warehouse design, it has been necessary to design lift trucks which are sufficiently narrow in width to negotiate relatively narrow aisles, yet have the capability of placing a load on a rack which may be as high as 40 feet (12.2 m) above the floor of the warehouse. Lift trucks of this type may comprise a frame having a rearwardly mounted power unit and forward load wheels, a primary mast having a mainframe mast extending upwardly from the frame, and a second stage mast mounted to and movable relative to the mainframe mast. A main carriage is mounted to and movable relative to the second stage mast, and preferably includes a platform with an operator's station and a swivel-mounted lifting fork which in some models is carried by an auxiliary mast attached to the platform. Thus, the operator as well as the lifting forks can be elevated to the appropriate level so the operator can direct the forks to deposit or retrieve items from a shelf or bin which is elevated above the floor.

One problem inherent in such devices is that, when fully extended, the lifting masts become less stable in response to bending moments or torsional loads. Bending moments of a relatively large magnitude occur when a heavy pallet is placed on the forks, and can be in a front-to-back or longitudinal direction when the pallet is in front of the truck, and in a side-to-side or transverse direction when the pallet is to the side of the truck, such as during loading or unloading operations. Torsional stresses may result from the movement of the lift truck or relatively rapid movement of the lifting forks when supporting a pallet of relatively heavy articles. Such loads may cause front-to-back, side-to-side, and/or twisting motion of the primary mast. Accordingly, it is necessary to design the primary masts of such lift trucks to be sufficiently rigid to withstand bending moments and torsional loads, yet possess economy of material and design to minimize fabricating costs and weight.

One example of such a lift truck is disclosed in the van der Laan U.S. Pat. No. 3,937,346. That patent discloses a lift truck having a frame to which is mounted a vertically oriented outer mast that supports an inner mast for vertical movement by a pair of hydraulic cylinders. Each of the masts comprises a pair of parallel, vertically extending channel beams, located at a forward portion of the mast, and a box beam located at a rearward portion and joined to the channel beams by a plurality of transverse beams spaced along the length of the mast. Each channel beam defines a track, and includes rollers which are positioned to engage the track of an adjacent beam of the other mast to provide rolling engagement between the inner and outer masts. The box beams each include guide plates which extend along its length to provide a guide surface against which the other box beam slides to resist transverse bending moments which would tend to bind the rollers in the tracks.

A platform, having an auxiliary mast with turret-mounted forks, is supported by rollers between the tracks of the inner movable frame, and is displaced relative to the inner frame by hydraulic cylinders. Thus, the operator, seated in the platform, can be elevated to the top of the inner mast, and the inner mast elevated relative to the outer mast to place the operator at elevated positions where he can manipulate the forks to deposit or retrieve loads on various shelves of a storage rack.

A disadvantage of this device is that the open framework of the masts is inherently susceptible to twisting in response to torsional stresses. As a result, it is necessary to include the massive, expensive and heavy box beams and transverse beams having a rectangular channel construction to strengthen the masts. While the guide plates help resist transverse bending movements, they add an undesirable element of sliding friction to the movement of the masts, thereby increasing the power required to lift the inner mast.

SUMMARY OF THE INVENTION

The present invention is a lift truck having a two-stage primary mast which provides superior strength for its size and weight, to resist bending moments exerted by loading stresses in both transverse and longitudinal directions, as well as superior strength in response to torsional stresses, when compared to lift trucks in the prior art. Furthermore, the primary mast is relatively lightweight, easy to fabricate, and inexpensive when compared to the mast structures of comparable lift trucks in the prior art, and has the additional advantage that contact between the mainframe mast and the movable second stage mast is limited to rolling contact; that is, there is no need for guide plates to maintain alignment between fixed and movable primary mast sections.

The present invention is a lift truck having a frame, a mainframe mast attached to and extending upwardly from the frame, a second stage mast mounted on the mainframe mast and sized to telescope over it with sufficient clearance to prevent contact with the mainframe mast, a lifting form structure movably mounted to the second stage mast for engaging and supporting a load, and hydraulic actuator cylinders for raising the second stage mast relative to the mainframe mast and raising the lifting fork structure relative to the second stage mast. The mainframe mast and second stage mast each comprise a continuous, tubular body having a pair of parallel beams, integral with the body, extending its entire length.

As used herein to describe the bodies of the mainframe mast and second stage mast, the term "continuous" means that the sides of the mast bodies are without substantial openings for their entire lengths. There will, of course, be relatively small openings so that house and cables can be fed to the interiors of the masts, and holes to receive mounting bolts for accessories. It has been found that this continuous structure is sufficiently strong in its ability to withstand bending and torsional stresses so that the mainframe and second stage masts can be made of steel plate without box beam reinforcement, and can be narrower in width and length than the platform they support. This is in contrast to prior art lift trucks, such as the lift truck disclosed in the previously mentioned van der Laan U.S. Pat. No. 3,937,346, in which each mast component comprises an open framework having vertically extending box beams joined together by transversely extending rectangular channel beams, and partially surrounds the platform.

Accordingly, in a preferred embodiment of the invention, the mainframe and second stage mast bodies comprise a front wall extending between the beams, a pair of side walls extending rearwardly from the beams, and a rear wall, opposite the front wall and extending between the side walls. The front, side, and rear walls are joined to each other and are integral with the beams to form the continuous, unitary structure. Also in the preferred embodiment, the side and rear walls are made from sections of steel plate which are formed in the shape of a channel and welded together to form a unitary structure. One longitudinal edge of the structure is attached to a first beam, and the other longitudinal edge is attached to the second beam, defining a space which may conveniently enclose the lift cylinders, chains, control cables or conduits, etc.

In addition to adding strength to the mainframe and second stage masts, the beams also define vertically extending tracks. Both the mainframe and second stage masts include rollers fixed to its beams and positioned to engage the beam tracks of the other masts. Each of the masts has two sets of rollers: a first set in which the rollers rotate about axes oriented transversely, and a second set which rotate about axes extending longitudinally. Thus, the first set of rollers withstands bending loads in a longitudinal direction, and the second set supports the masts in response to bending loads in a transverse direction. As a result of the inherent strength of the continuous mast structure, and the strength added by the beams, no other than rolling contact is necessary between the masts, minimizes the power required to lift the second stage mast by eliminating sliding friction between the mast parts.

The beams of the second stage mast also define tracks facing sidewardly and outwardly from the mainframe mast structure. In a preferred embodiment, the lifting fork structure includes rollers which are oriented in longitudinal and transverse directions and which ride against these tracks, so the platform can withstand both transverse and longitudinal bending stresss. Thus, the contact between the platform and the second stage mast is also limited to a rolling contact.

Although the following description of the preferred embodiment is directed to lift trucks commonly known as "man up" types, in which the operator is located on a platform mounted on the second stage mast, and forming a part of the lifting fork structure, the two stage mast structure of the invention can be employed in other types of lift trucks as well, without departing from the scope of the invention. For example, the mast structure can be used in a "man down" type truck, such as that shown in the aforementioned U.S. Pat. No. Re. 24,958, in which the lifting fork structure consists only of a fork carriage mounted on the second stage mast, and the operator cab is located behind and is separate from the masts. Alternatively, the masts of the invention could be used in a man up truck of the type in which the platform is mounted to the rear of the second stage mast opposite the fork carriage.

Accordingly, it is an object of the present invention to provide a lift truck having a two-stage primary mast in which both the mainframe mast and second stage mast comprise continuous and relatively lightweight tubular bodies which provide superior strength to resist bending and torsional loads; a lift truck in which the only contact between the second stage and mainframe masts is a rolling contact; a lift truck in which the effective size of the mainframe and second stage masts are minimized so that the overall size of the lift truck is held to a minimum; and a lift truck having a two-stage primary mast which supports a lifting fork structure such that the contact between the platform and primary mast is limited to a rolling contact.

Other objects and advantages of the invention will be apparent from the following description, the accompanying drawings and the appended claims.

DESCRIPTION OF THE PREFERRED EMBODIMENT

Figure 1:
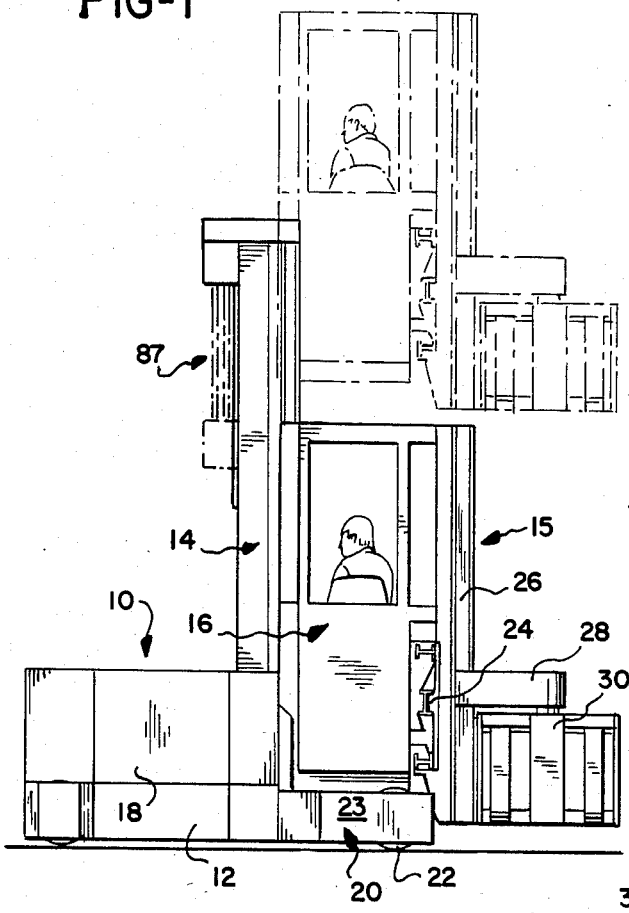
FIG. 1 is a somewhat schematic side elevation of the lift truck of the present invention, showing in phantom the platform in a raised position.
Figure 1:
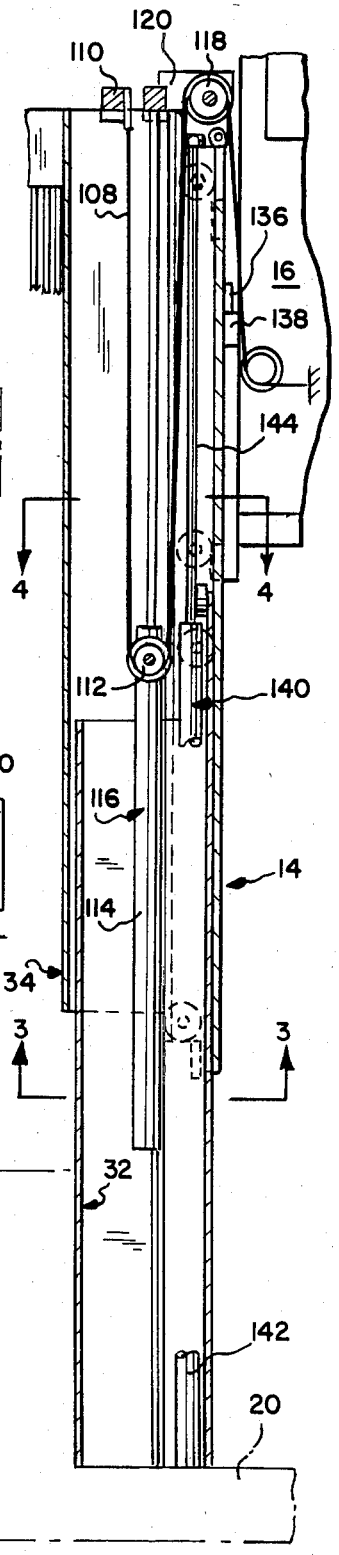
Figure 2:
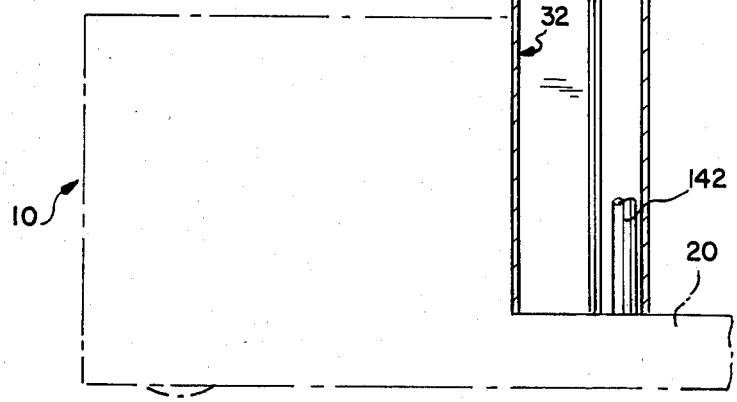
FIG. 2 is a detail of the primary mast of the lift truck of FIG. 1 showing the mast in section.

As shown in FIGS. 1 and 2, the lift truck of the present invention, generally designated 10, consists of a frame 12, primary mast 14, and a main carriage 15 which includes platform means 16. The frame 12 includes a rearwardly mounted power unit 18 and a forwardly extending load wheel frame 20 having load wheels 22 attached thereto. The load wheel frame includes outriggers 23 spaced apart a distance which is determined by the requirements of the particular application of the truck.

The main carriage 15 includes a side shift carriage 24 mounted forwardly of the platform 16 and capable of side-to-side movement relative to the platform. An auxiliary mast 26 is mounted to the side shift carriage 24 and is capable of transverse movement relative to the side shift carriage. The auxiliary mast 26 supports a turret arm 28 having a fork assembly 30 attached thereto and capable of relative pivotal movement. The detailed structures of the frame 12, side shift carriage 24, auxiliary mast 26, turret arm 28 and fork assembly 30 are all well-known in the art and are typical of high quality, modern lift trucks.

Figure 3:
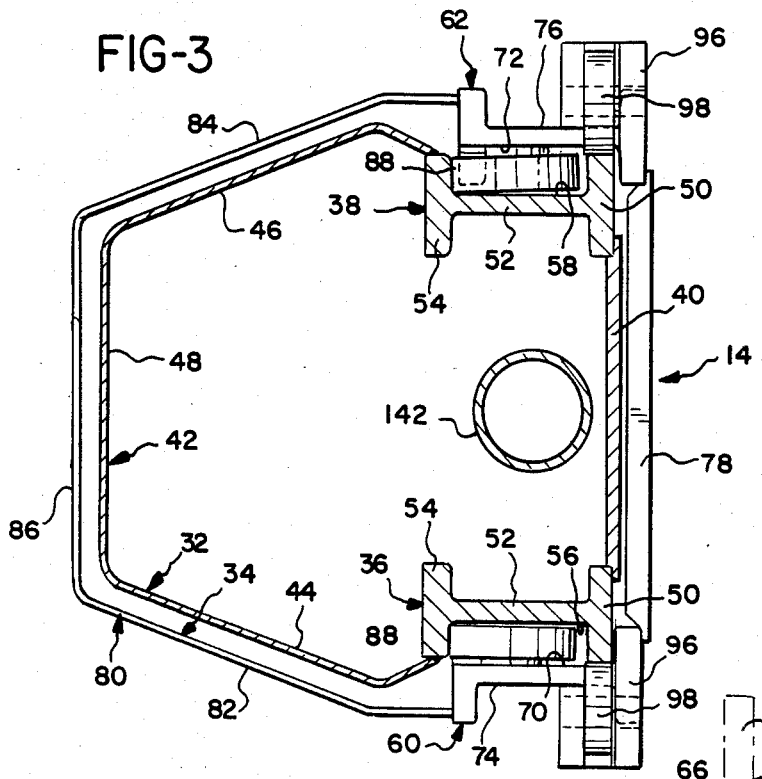
FIG. 3 is a section of the primary mast taken at line 3—3 of FIG. 2.
Figure 4:
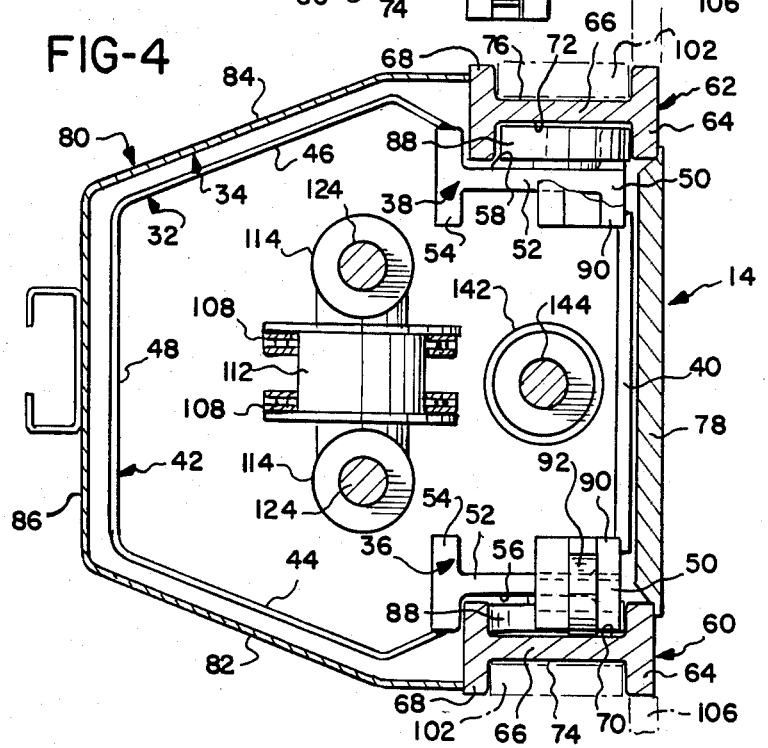
FIG. 4 is a section of the primary mast taken at line 4—4 of FIG. 2.

As shown in FIGS. 2, 3, and 4, the primary mast 14 consists of a mainframe mast 32 and a second stage mast 34. The mainframe mast 32 is attached to and extends verically upwardly from the load wheel frame 20 at a position immediately rearward of the wheels 22, and is integral with the load wheel frame. The mainframe mast 32 includes a pair of opposing I-beams 36, 38 at a forward portion thereof, a continuous front wall 40 extending between the beams, and a continuous channel 42 which is attached at one longitudinal edge thereof to beam 36 and at the other longitudinal edge to beam 38. The channel 42 includes opposing side walls 44,46 and a rear wall 48, oriented opposite the front wall 40.

Beams 36,38 include forward flanges 50, webs 52 and rearward flanges 54 to which are attached the channel 42. The webs 52 and outwardly extending portions of the flanges 50,54 form vertically extending tracks 56,58.

Similarly, the second stage mast 34 includes a pair of I-beams 60,62 oriented parallel to each other and located forwardly of the mast and immediately adjacent the tracks 56,58 of I-beams 36,38. The I-beams 60,62 include forward flanges 64, webs 66 and rearward flanges 68. The inwardly extending portions of the forward and rearward flanges 64,68, together with the inwardly facing sides of the webs 66, form inner tracks 70,72 which open toward the tracks 56,58 of the I-beams 36,38. The outwardly facing portions of the flanges 64,68 and webs 66 form outer tracks 74,76.

The forward flanges 64 of I-beams 60,62 are joined by a continuous front wall 78, extending substantially the entire length of the second stage mast 34, and the rearward flanges 68 are attached to continuous channel 80 such that a longitudinal edge of the channel is attached to the flange of beam 60 and the other longitudinal edge of the channel is attached to the flange of beam 62. The continuous channel 80 includes opposing side walls 82,84 and rear wall 86. A hydraulic hose take-up mechanism (FIG. 1), generally designated 87, of well-known design, is attached to rear wall 86.

Thus, both the mainframe mast 32 and second stage mast 34 comprise continuous, tubular bodies. The second stage mast 34 is sized such that it telescopes over the top of mainframe mast 32 with sufficient clearance that there is no point of contact between the two masts. Although the components of the mainframe mast 32 and second stage mast 34 may be joined by any well-known means, it is preferable that the components be joined by welds such that each mast comprises a unitary weldment.

Figure 5:
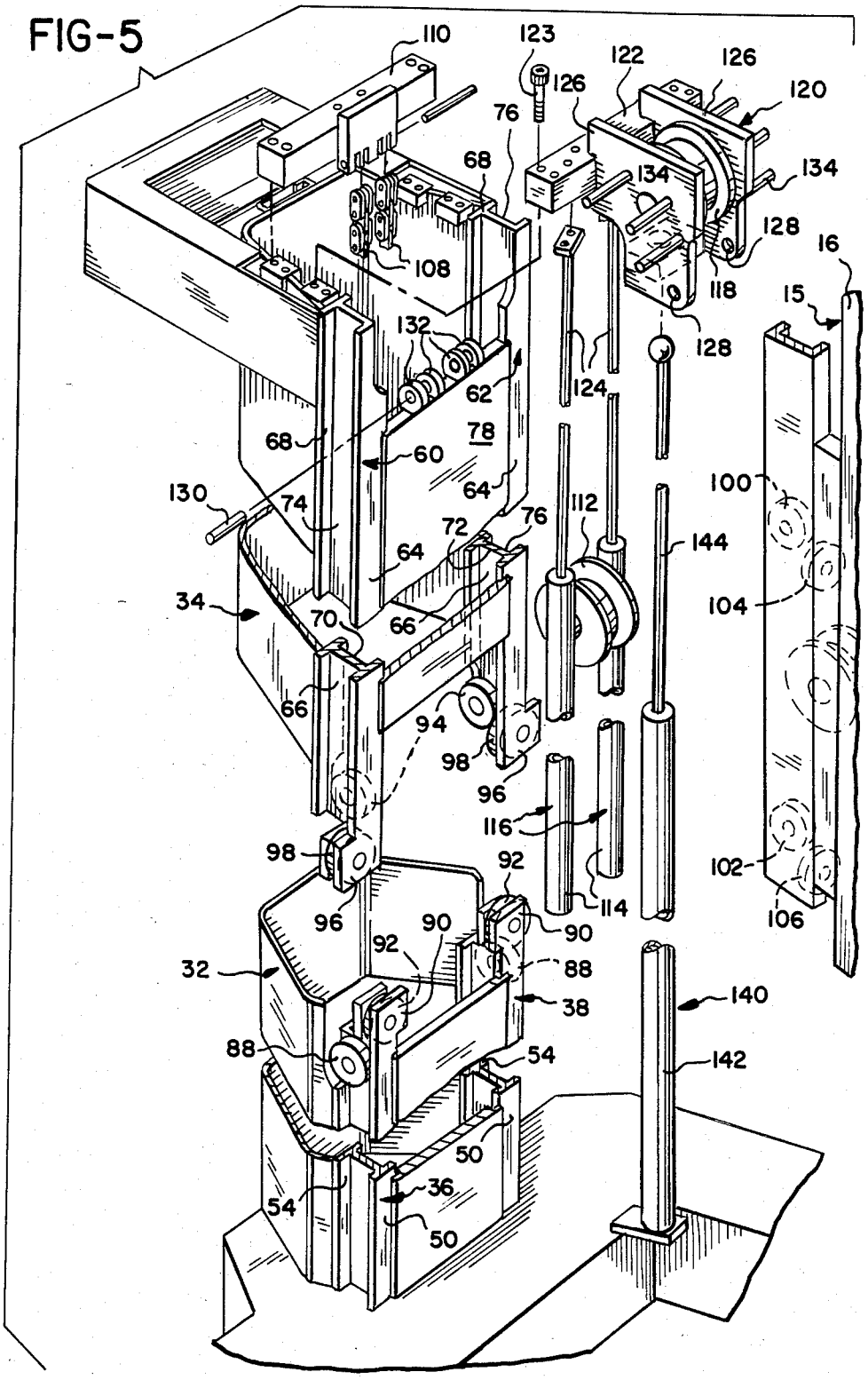
FIG. 5 is an exploded, perspective view of the primary mast of the lift truck of FIG. 1.

As best shown in FIGS. 3, 4 and 5, the I-beams 36, 38 of the mainframe mast 32 include a pair of rollers 88 attached at upper ends thereof and oriented so that their axes of rotation extend transversely. The rollers are positioned such that they engage either the forward or rearward flanges 64,68 of the inner tracks 70,72 of the second stage mast 34. The mainframe mast also includes clevises 90 extending upwardly therefrom that support rollers 92 having axes of rotation that extend substantially longitudinally and are positioned to engage the webs 66 of the inner tracks 70,72 of the I-beams 60,62.

Similarly, the I-beams 60,62 of the second stage mast 34 include rollers 94, mounted at lower ends of the I-beams, which are positioned such that their axes extend substantially transversely, and they contact the forward and rearward flanges 50,54 of the tracks 56,58 of I-beams 36,38. A pair of clevises 96 extend outwardly from the lower surfaces of the beams 60,62 and support rollers 98 which are sized and positioned to engage the outer edges of the forward flanges 50 of the beams 36,38 of the mainframe mast 32.

Thus, both the mainframe mast 32 and second stage mast 34 have two sets of rollers, a first set—rollers 88,94—to provide rolling contact between the masts in opposition to longitudinal bending loads, and a second set—rollers 92,98—which provide rolling contact between the masts in opposition to transverse bending loads. The aforementioned sets of rollers provide the only contact between the mainframe and second stage masts 32,34 and there is no sliding contact between them. Furthermore transverse bending loads resisted by the beams 36, 38, 60, 62 do not move the beams from their parallel alignment since the beams are joined and stiffened by front walls 40, 78 respectively.

As shown in FIGS. 4 and 5, the main carriage 15 and platform 16 includes a pair of upper rollers 100 and a pair of lower rollers 102 which are positioned such that their axes of rotation are oriented transversely and engage the flanges 64,68 of the outer tracks 74,76 of beams 60,62. Platform 16 also includes a pair of upper rollers 104 and a pair of lower rollers 106, oriented such that their axes of rotation extend longitudinally, and positioned on the platform such that they contact the outer edges of forward flanges 64 of beams 60,62. Thus, in a manner similar to the sets of rollers which provide the engagement between the mainframe mast 32 and second stage mast 34 (shown in FIGS. 3–5) upper and lower rollers 100,102 provide a connection between the platform 16 and second stage mast 34 which bears longitudinal bending loads, and pairs of rollers 104,106 provide a connection between the platform and second stage mast which resists transverse bending loads.

As shown in FIGS. 2, 6, 8 and 9, the main carriage 15 is raised and lowered on the second stage mast 34 by a lifting mechanism which includes a pair of lifting chains 108. Lifting chains 108 are attached at one end to a chain anchor 110 which is bolted to the top of the second stage mast 34 (FIG. 5), and at the other end to the platform 16 by well-known means (not shown). The path of chain travel is defined by a pulley 112, rotatably mounted to the cylinders 114 of a pair of hydraulic cylinders or actuators 116, and a fixed pulley 118 which is mounted to a tipout member 120 (also shown in FIG. 4).

Figure 6:
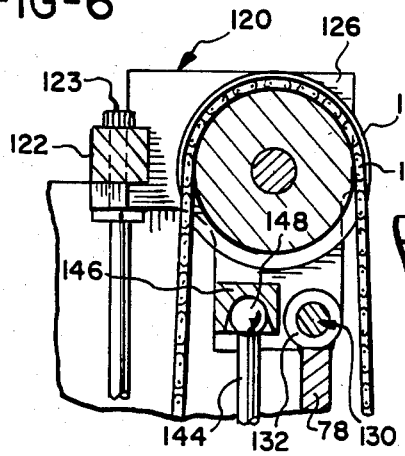
FIG. 6 is a detail of the top of the second stage mast of FIG. 5 showing the tipout in place.
Figure 7:
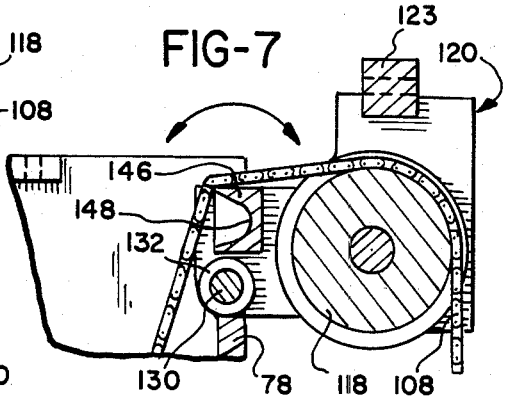
FIG. 7 is a detail of the top of the second stage mast of FIG. 6 showing the tipout in a pivoted position.

The tipout 120, shown in FIGS. 5, 6 and 7, includes a rear bar 122 which is attached by bolts 123 to the top of the second stage mast 34 and supports the rods 124 of the actuators 116 such that the actuators and pulley 112 extend downwardly within the mainframe mast 32. The tipout 120 includes a pair of opposing walls 126 which have openings 128 at lower ends thereof to receive pins 130 (only one of which is shown) which fasten the walls to knuckles 132 formed on the front wall 78 of the second stage mast 34 so that the tipout can be pivoted from the position shown in FIG. 6 forwardly to the position shown in FIG. 7, after detachment of the rear bar 132 from the top of the second stage mast 34. The tipout 120 also includes axles 134 extending sidewardly from the walls 126 to which are attached rollers (not shown) to support hydraulic hoses and electrical cable extending from the power unit 18 (FIG. 1) to the platform 16. Thus, the chains 108 extend downwardly from the chain anchor 110 within the mainframe mast 32, around the free lift pulley 112, upwardly to the tipout pulley 118, then downwardly to the connection within the platform 16.

An advantage of the tipout 120 is that its hinged construction allows the tipout to be pivoted forwardly, as shown in FIG. 7, so that maintenance personnel may gain access to the interiors of the second stage mast 34 and mainframe mast 32, particularly for servicing the cylinders and other mechanisms contained therein.

Figure 8:
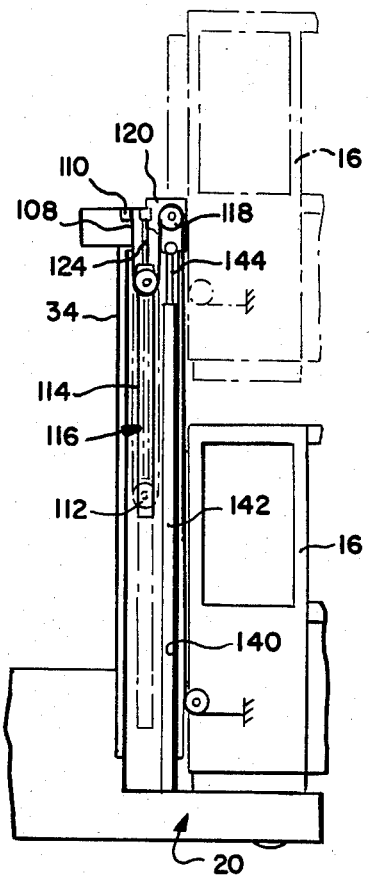
FIG. 8 is a schematic detail of the lift truck of FIG. 1 showing the platform and second stage mast in a lowered position.
Figure 9:
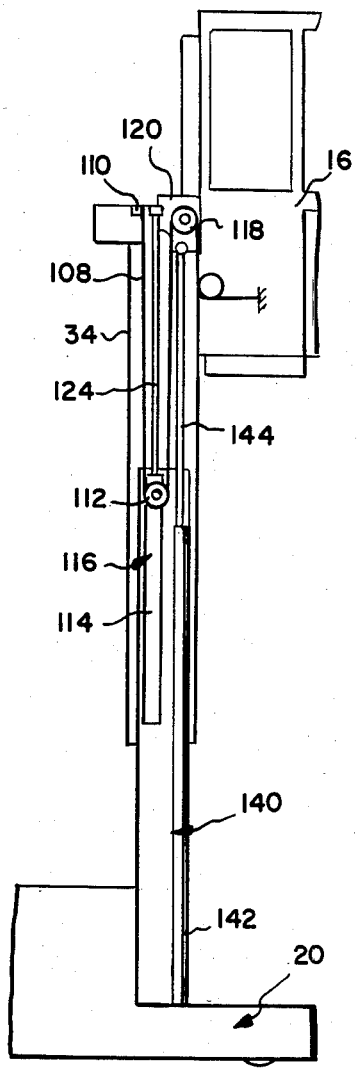
FIG. 9 is a schematic detail of the lift truck of FIG. 8 showing the platform and second stage mast in a raised position.

In operation, best shown in FIGS. 8 and 9, the free lift actuators 116 are activated such that their rods 124 extend outwardly from their cylinders 114, thereby displacing the pulley 112 downwardly toward the outriggers 20. This increases the length of the lifting chains 108 within the mainframe mast 32 and draws the platform 16 upwardly relative to the second stage mast 34. The upper limit of travel of the platform 16 can be limited in any number of ways, such as inclusion of stops 136,138 (FIG. 2) mounted to the second stage mast 34 and platform 16, respectively.

As shown in FIGS. 2, 5–9, second stage mast 34 is raised and lowered relative to the mainframe mast 32 by a main or free lift hydraulic cylinder or actuator 140. The main actuator 140 includes a cylinder 142 which is attached to the outrigger structure 20 by conventional means (not shown). The rod 144 of the actuator 140 extends upwardly and is attached to the tipout 120 at a crossbar 146 thereof by a spherical bushing 148.

In operation, shown in FIGS. 8 and 9, extension of the rod 144 from the cylinder 142 urges upwardly the tipout 120, and second stage mast 34 to which it is attached, thereby raising the second stage mast relative to the mainframe mast 32. It should be noted that the position of the platform 16 relative to the second stage mast 34 remains fixed during the second stage mast lifting operation, since the actuators 116 are attached to the tipout 120 of the second stage mast and are not attached to the mainframe mast 32 or lift truck frame 12. Although not shown, the actuators 116,140 are a part of a hydraulic system powered by the power unit, and can be one of many systems readily apparent to one having skill in the art.

In the alternative, a system may be used such as that disclosed in U.S. Pat. No. 4,087,626 in the name of Luebrecht et al. and entitled "Improved Method and Apparatus for Side Shift Carriage Control", the disclosure of which is incorporated herein by reference.

While the form of apparatus herein described constitutes a preferred embodiment of this invention, it is to be understood that the invention is not limited to this precise form of apparatus, and that changes may be made therein without departing from the scope of the invention.

What is claimed is:

1. A lift truck comprising:

a frame;

a mainframe mast attached to and extending upwardly from said frame, said mainframe mast having a first pair of parallel, vertically-extending beams, a continuous, substantially flat, relatively thin-walled front wall attached to and extending between said first pair of beams and a continuous, relatively thin-walled, vertically-extending rear channel having a substantially flat rear wall opposite said front wall and a pair of opposing side walls extending rearwardly from said beams and having longitudinal edges attached thereto, said beams, front walls and channel forming a substantially enclosed, continuous body;

a second stage mast positioned to telescope over an exterior of said mainframe mast and having a second pair of parallel, vertically-extending beams, a continuous, substantially flat, relatively thin-walled outer front wall attached to and extending between said second pair of beams, and a continuous, relatively thin-walled, vertically-extending outer rear channel having a substantially flat outer rear wall opposite said outer front wall and a pair of opposing outer side walls extending rearwardly from said second pair of beams and having longitudinal edges attached thereto, said second pair of beams, outer front wall and outer rear channel forming a substantially enclosed, continuous outer body sized to telescope over but not contact said mainframe mast;

said mainframe mast including a first pair of transverse rollers having rotational axes oriented substantially transversely, and a first pair of longitudinal rollers having rotational axes oriented substantially longitudinally, said first pairs of rollers engaging said second pair of beams;

said second stage mast having a second pair of transverse rollers having axes oriented substantially transversely, and a second pair of longitudinal rollers being substantially coplanar with said front wall of said mainframe mast and having rotational axes oriented substantially longitudinally, said second pairs of rollers engaging said first pair of beams, whereby contact between said mainframe mast and said second stage mast is limited to rolling contact by said rollers against said beams;

lifting fork means movably mounted to said second mast; and means for elevating said second stage mast relative to said mainframe mast and for elevating said lifting fork means relative to said second stage mast.

2. The lift truck of claim 1, wherein said raising and lowering means includes primary actuator cylinder means attached to an upper portion of said second mast and extending downwardly within said mainframe mast and supporting first chain pulley means, such that extension of said primary actuator cylinder means displaces said first chain pulley means away from said upper portion; and second chain pulley means attached to said second mast upper portion adjacent said forward wall thereof; and chain means attached at an end thereof to said second mast upper portion, extending downwardly to and about said first chain pulley means, thence upwardly to and about said second chain pulley means, thence to said lifting fork means and attached thereto at an opposite end of said chain means.

3. The lift truck of claim 2 wherein said raising and lowering means further includes secondary actuator cylinder means attached to and extending between a lower portion of said mainframe mast and said second mast upper portion.

4. The lift truck of claim 3 wherein said second chain pulley means includes a pulley supporting said chain and means pivotally mounted to said second mast upper portion such that said second chain pulley means may be pivoted upwardly and away from said second mast upper portion, thereby facilitating access to the interior thereof.

5. The lift truck of claim 1 wherein sad mainframe and second masts are each unitary weldments.

6. The lift truck of claim 1 wherein said lifting fork means comprises a main carriage having a platform; a side shift carriage attached to said platform; an auxiliary mast attached to a forward portion of said sideshift carriage; and a turret arm and fork assembly attached to a forward portion of said auxiliary mast.

7. The lift truck of claim 1 wherein said lifting fork means includes a third pair of transverse rollers having rotational axes oriented substantially transversely, and a third pair of longitudinal rollers having rotational axes oriented substantially longitudinally and being substantially coplanar with said outer front wall of said second stage mast, said third pairs of transverse and longitudinal rollers engaging an outer portion of said second pair of beams.

8. A lift truck comprising:

a frame;

a first mast attached to and extending upwardly from said frame;

a second mast mounted on said first mast and sized to telescope thereover with sufficient clearance to prevent contact therebetween;

each of said masts having a substantially continuous, unitary tubular body and including beams extending the entire length thereof and integral with said body, said bodies of said first and second masts each including front and rear walls and opposing side walls, each of said walls being substantially planar in shape;

said beams of each of said masts comprise a pair of track beams oriented parallel to each other and including track means extending along the lengths thereof;

said front walls of said first and second masts extending between and attached to said pair of track beams associated therewith;

roller means positioned between said masts adjacent said beams to engage said track means and to provide rolling engagement between said masts;

lifting fork means movably mounted on said second mast for engaging and supporting a load;

means for raising and lowering said second mast relative to said first mast and said lifting fork means relative to said second mast; said raising and lowering means including primary actuator cylinder means attached to an upper portion of said second mast and extending downwardly within said first mast and supporting first chain pulley means, second chain pulley means attached to said second mast upper portion adjacent said forward wall thereof, and chain means attached at an end thereof to said second mast upper portion, extending downwardly to and about said first chain pulley means, thence upwardly to and about said second chain pulley means, thence to said lifting fork means and attached thereto at an opposite end of said chain means;

said raising and lowering means further including secondary actuator cylinder means attached to and extending between a lower portion of said first mast and said second mast upper portion; and said second chain pulley means including a pulley supporting said chain and means pivotally mounted on said second mast upper portion such that said second chain pulley means may be pivoted upwardly and away from said second mast upper portion, thereby facilitating access to the interior thereof.

* * * * *